US011851230B2

(12) United States Patent
Partansky et al.

(10) Patent No.: US 11,851,230 B2
(45) Date of Patent: Dec. 26, 2023

(54) AUTOMATED FILLING OF CARTRIDGE ARRAY WITH VISCOUS LIQUID UTILIZING ANNULAR NOZZLES

(71) Applicant: Sorting Robotics Inc., Van Nuys, CA (US)

(72) Inventors: Nohtal Partansky, Los Angeles, CA (US); Paul Skaar, Long Beach, CA (US); Diego Torres, Los Angeles, CA (US); Sean Lawlor, Los Angeles, CA (US)

(73) Assignee: Sorting Robotics Inc., Van Nuys, CA (US)

( * ) Notice: Subject to any disclaimer, the term of this patent is extended or adjusted under 35 U.S.C. 154(b) by 167 days.

(21) Appl. No.: 17/388,003

(22) Filed: Jul. 28, 2021

(65) Prior Publication Data

US 2022/0033124 A1 Feb. 3, 2022

Related U.S. Application Data

(60) Provisional application No. 63/058,477, filed on Jul. 29, 2020.

(51) Int. Cl.

| | |
|---|---|
| ***B65B 39/12*** | (2006.01) |
| ***B65B 63/08*** | (2006.01) |
| ***B65B 3/12*** | (2006.01) |
| ***B67C 3/26*** | (2006.01) |
| ***B67C 3/22*** | (2006.01) |
| ***B65B 29/00*** | (2006.01) |
| *B65B 59/04* | (2006.01) |

(Continued)

(52) U.S. Cl.

CPC ..... *B65B 63/08* (2013.01); *B65B 3/12* (2013.01); *B65B 29/00* (2013.01); *B67C 3/225* (2013.01); *B67C 3/26* (2013.01); *B65B 59/003* (2019.05); *B65B 59/04* (2013.01); *B65B 2039/009* (2013.01); *B67C 2003/226* (2013.01)

(58) Field of Classification Search

CPC ..... B65B 63/08; B65B 3/12; B65B 59/04; B65B 2039/009; B65B 29/00; B67C 3/225; B67C 3/26; B67C 2003/226

See application file for complete search history.

(56) References Cited

U.S. PATENT DOCUMENTS 10,279,934 B2 * 5/2019 Christensen ..... B65B 3/18
10,583,949 B1 * 3/2020 Ellis ..... B65B 3/12

(Continued)

*Primary Examiner* — Nicolas A Arnett
(74) *Attorney, Agent, or Firm* — Cognition IP, P.C.; Edward Steakley

(57) ABSTRACT

A system to automate the filling of electronic vape cartridges with viscous liquid. The system includes an enclosure sealed with removable panels for maintenance access, compartments to interface cartridges and liquids with the internal mechanisms, and an external human machine interface. The internal mechanisms utilize thermally insulative annular nozzles and a thermal control system to diminish the internal friction of the liquid to facilitate consistent transfer of liquid between a reservoir, heated by a heated bed, syringe assembly, comprising a heating element along a raceway, and empty cartridges inserted into the system. This system is capable of filling approximately 100 cartridges per minute, and may interface with cartridges of various configurations and formulations of varying composition and characteristics.

20 Claims, 4 Drawing Sheets

(51) Int. Cl.
*B65B 39/00* (2006.01)
*B65B 59/00* (2006.01)

(56) References Cited

U.S. PATENT DOCUMENTS

| | | | | |
|---|---|---|---|---|
| 11,549,959 | B2 * | 1/2023 | Williams | G01N 35/1065 |
| 2003/0072683 | A1 * | 4/2003 | Stewart | C30B 7/00 117/68 |
| 2003/0230488 | A1 * | 12/2003 | Lee | G01N 27/44743 204/600 |
| 2004/0101589 | A1 * | 5/2004 | Babin | B29C 45/2737 425/549 |
| 2012/0152406 | A1 * | 6/2012 | Bartholomew | B65B 3/04 141/104 |
| 2012/0171678 | A1 * | 7/2012 | Maltezos | B01L 7/52 435/6.12 |
| 2017/0045542 | A1 * | 2/2017 | Lapham | G01N 35/10 |
| 2017/0121169 | A1 * | 5/2017 | Dailey | B65B 57/145 |
| 2018/0250753 | A1 * | 9/2018 | Frank | B23C 5/28 |
| 2022/0033124 | A1 * | 2/2022 | Partansky | B67C 3/26 |

* cited by examiner

300

400

500

AUTOMATED FILLING OF CARTRIDGE ARRAY WITH VISCOUS LIQUID UTILIZING ANNULAR NOZZLES

CROSS-REFERENCE TO RELATED APPLICATION

This application is a non-provisional of, and claims the benefit of U.S. Provisional Patent Application No. 63/058,477, filed Jul. 29, 2020, which is hereby incorporated by reference it its entirety.

FIELD

The present disclosure relates generally to automation technology in simultaneously filling an array of electronic vaporizer cartridges with viscous formulations of varying composition and properties.

BACKGROUND

Cartridges, such as those used in electronic vaporizers, must be filled with oil or other formulation before being sealed and used with the electronic base of the vaporizer.

In many implementations, this formulation may have a viscosity above 5,000 centipoise, which in certain implementations may be considered high viscosity, such that it does not flow easily or freely at room temperature in a manner which is expeditious. This is particularly counterproductive in high volume production environments where the available time to complete a single piece is quite low, on the order of seconds or less.

Existing implementations attempt to remedy this difficulty with thermal systems that raise the temperature of the formulation sufficiently to facilitate free flow. However, these implementations poorly propagate heat throughout the system such that heating is non uniform. This causes variable viscosity across the formulation, which is undesirable because inconsistent viscosity will lead to uneven flow characteristics and may also negatively impact the chemical composition of the formulation if overheated.

For example, the Thompson Duke filling system uses a heated reservoir and heat lamps to facilitate flow from the reservoir to the cartridges to fill one to two cartridges at a time. A pneumatically actuated syringe discharges the collected formulation from the barrel into a cartridge, and the bed which holds the array of cartridges indexes forward to the next empty cartridge. At the same time, the pneumatic syringe retracts and recharges the barrel with additional formulation from the reservoir. The radiative heat lamps in particular, pointed at the tube between the reservoir and syringe barrel, have a tendency to overheat the formulation closest to the lamp. Further, the lamps in the aforementioned implementation hold position poorly and require constant adjustment and manual tweaking by an operator to approximate the desired temperature of the fluid inside the tube.

Another example, the Convectium filling system, uses an array of needles to fill an equivalent array of cartridges simultaneously, which has advantages over the Thompson Duke approach with single or two-piece filling. The primary advantage centers on the capillary action of the formulation inside the enclosed cartridge. Once filled and capped, the capillary effect of a small piece of cotton drawing in the formulation from the sealed internal volume creates a vacuum which prevents the formulation from escaping the enclosed cartridge due to the higher relative atmospheric pressure outside of the cartridge.

Due to the serial nature of the Thompson Duke implementation, the first cartridge filled will rest for a number of minutes as the system fills some number of cartridges after. Via this capillary action, the formulation has time to seep into the fabric located at the heating element while pulling in ambient air into the open volume above the formulation. Once the fabric is saturated the amount of vacuum pulled once capped is insufficient to keep the formulation from leaking.

In the simultaneous cartridge fill approach utilized by Convectium, a heating element and thermistor work in tandem to control the temperature of formulation across an array of small volume reservoirs bored out of a metallic block, each reservoir equivalent to a syringe barrel. During the charging phase, an array of plungers simultaneously draw formulation through the array of needles into each barrel from a reservoir. During the discharge phase the barrels simultaneously expel the formulation through the array of needles into the array of cartridges in the next step of the cycle. The implementation of this thermal control system is problematic, however, as the low number of heater elements and distantly located temperature probes produce uneven heating across the array of barrels. With both implementations this can lead to a general need to heat the system to a higher temperature to ensure all barrels and formulation reach the necessary threshold to facilitate filling.

The process for filling cartridges first starts with formulation inserted into a reservoir inside the system. The reservoir is heated to keep the viscosity of the formulation within the reservoir at the appropriate temperature such that the formulation may be readily transferred. Second, during the charging phase, a measured volume of formulation is pulled into a cavity or plurality of cavities, each functionally equivalent to a syringe barrel, via the action of a plunger retracting to create a volume for the formulation to fill. A heater system has already warmed the area surrounding the barrel(s) such that when the formulation leaves the reservoir and enters the barrel(s), the formulation in the barrel(s) continues to remain at the appropriate temperature to ensure transferability. Third, with the formulation held within the barrel(s), and the appropriate number of cartridges aligned with the applicators, the plunger pushes the formulation out of the barrel, through the applicator, and discharges into the cartridges.

A metallic needle or similar cannula is utilized as the applicator to transmit formulation from the barrel(s) to the cartridges in the existing implementations. In the case of the Convectium implementation, the applicators also facilitate transfer from the reservoir into the barrels prior to filling the cartridges. In both implementations, the ambient air around the applicators is not actively controlled, and thus the efficacy of the thermal systems is diminished as soon as the formulation contacts the relatively cooler applicator. The thin-walled, high thermal conductivity nature of these metallic applicators or equivalent implementations dissipates much of the heat absorbed by the formulation in the barrel(s) and may cause unintended cooling of the formulation along the applicator length.

The Thompson Duke implementation exposes the cannula to the ambient room environment, and in the case of the Convectium implementation the large enclosure door is opened after every fill cycle, and thus the ambient environment around the applicator is equivalent to the ambient room environment despite the enclosure.

In the case of the Convectium system, thermal losses are exacerbated by the long needle length of around three inches. This cooling may result in blockages within the applicator if the barrel temperature is not high enough to ensure that the formulation temperature as it exits the tip of the applicator remains high enough to ensure full discharge. As with the uneven heating approaches discussed previously, in practice this is remedied by increasing the temperature of the heating system to ensure liquid flow throughout the fill operation.

In each existing implementation, the thin-walled metallic applicators are circular in cross-sectional area, likely chosen due to the wide availability and variety of these components. The relatively small area through which the formulation passes exposes the formulation to the ambient environment as discussed previously, but also creates a high-pressure environment inside the barrels. In both implementations, the plungers have a silicon or similarly pliable tip which prevents formulation from slipping around the plunger tip and exiting the barrel on the rear side, which is entirely undesirable. In the Convectium implementation, the high-pressure environment inside each barrel, coupled with the need to generate sufficient force across the entire system to discharge more than one hundred barrels of formulation simultaneously, can lead to leaks and failures of seals as the distribution of this force may not be uniform given the previously discussed variance in viscosity across the system.

In the Convectium implementation, the long, metallic needles also create a significant problem with alignment, both upon initial installation and after extended use. Due to the pneumatically driven piston rod simply actuating between a minimum and maximum stop, there is no feedback system to identify error conditions, nor a way for the operator to adjust the system easily or repeatedly as with other means of motion such as motors. This requires the needles to be routinely re-aligned to mitigate potential damage to the cartridges or needles. This min-max actuation via pneumatics also creates an unknown actuation time and an unknown discharge profile which makes tuning the system to different formulations quite challenging, and significantly reduces repeatability between identical formulations. And again, paired with the uneven heating from the implemented thermal systems, leads to inconsistent behavior between barrels, further complicating the issues with sealing and reliable transmission over continued operation.

In the aforementioned implementation utilizing long metallic needles, the needles are hard mounted to the syringe assembly which makes replacement challenging.

Finally, the pneumatics-based operation of both discussed implementations requires additional sources of pressurized air for operation. In the case of the Convectium implementation, the large number of simultaneously filled and expelled barrels requires large pneumatic cylinders to generate the necessary force to discharge the formulation, which increases the overall size of the system. In particular, the needle array travels over multiple axes to facilitate charging from the reservoir, transition between the reservoir and cartridges, and discharge of the formulation into cartridges. These two attributes, namely the significant force required to transmit the viscous formulation, and the choice to have so many moving components, increase the system size drastically despite the relatively small work area.

SUMMARY

In certain implementations, filling an array of vape cartridges with formulation may be challenging due to the viscous nature of the formulation at room temperature. Certain existing implementations seek to solve this with technology designed to fill one to two cartridges at a time across an array of cartridges filled in series. This is problematic, however, as the time between the first cartridge fill and last cartridge fill may cause the cartridge to leak after capping. Other implementations seek to remove this leakage issue by filling a large array of cartridges in parallel such that any single cartridge is not uncapped for very long. Both existing implementations seek to remedy the viscosity issue by heating the formulation to decrease viscosity such that the formulation becomes more transferrable. However, these implementations produce non-uniform, non-repeatable, and difficult-to-tune thermal environments due to the implemented approaches for thermal control.

To remedy the thermal issues of the existing implementations, the heating element may instead be distributed across and in between the interstitials amongst the array of barrels in a raceway or other similar path. This will provide a segment of heating element adjacent to each barrel which will facilitate even heat distribution among all barrels. Similarly, the described system is easily tunable to achieve the necessary operating temperature, and most importantly improves the repeatability when changing between formulations. The described system mitigates the probability of overheating or underheating portions of formulation.

In certain implementations, the described system may also utilize a nozzle made from insulating material, such as plastic, instead of metal as in existing implementations. This decreases the thermal conductivity of the nozzle, such that heat loss out of the formulation is reduced compared to the metallic implementation.

In addition, instead of a needle or cannula with a circular cross section, the described system may utilize an annular nozzle to discharge formulation into cartridges. The annular shape increases the equivalent cross-sectional area which the formulation flows through. Many cartridges have a central vent tube which blocks the central area of the cartridge opening, and further means that formulation must be kept out of the vent tube such that the circular cross section of the standard needle or cannula is not geometrically suited to the available annular area around the vent tube. An annular nozzle with a hydraulic diameter of greater than 1.0 would be utilized in certain implementations to decrease the internal mechanical stresses experienced during operation, and to better utilize the annular area of the cartridge opening.

Further, the described system may use an enclosed workspace with only a small portal in certain implementations for inserting or removing cartridges during normal operation, such that the internal environment remains at a relatively constant temperature. In existing implementations there is either not an enclosure or the enclosure opening is so large that the enclosed environment is cooled down after every cycle. The described system may have removable sides which facilitate access to the internal work area for maintenance or troubleshooting.

Further, with an increasing inventory of cartridge configurations available in the market, the head assembly which houses the heater elements, barrels and plungers, and acts as a mounting location for the applicators (i.e., needles or cannulas), must be maintainable and interchangeable. The described system would have replaceable applicators such that if any applicators are damaged they may be replaced individually rather than replacing the entire head assembly. In certain implementations, the different cartridges may be filled in different configurations, such as a 13×9 array of one type, or 10×10 array of another type. For the described system, the head assembly is removable such that a different head assembly with a different number of barrels or configuration may be utilized.

Finally, in certain implementations, the system may be stacked vertically, such that the head assembly lies above the cartridge tray, which lies above the reservoir of formulation. In this way, the number of moving axes is minimized and motion is kept solely along the vertical axis. Further transitioning to electronic control components such as stepper motors in some implementations may decrease the overall dimensions of the system. The position of the reservoir below the cartridge tray also allows for an empty reservoir to be replaced while the system is filling an array of cartridges without halting that operation.

BRIEF DESCRIPTION OF THE DRAWINGS

These drawings and the associated description herein are provided to illustrate specific embodiments of the invention and are not intended to be limiting.

DETAILED DESCRIPTION

In certain implementations, an automated cartridge filling system would rest on top of a horizontal work surface. This system would be capable of filling an array of cartridges, in other implementations between 2 and 400 cartridges, with viscous oil formulation in approximately 1-minute cycle times, depending on the characteristics of the formulation and number of cartridges being filled.

Figure 1:
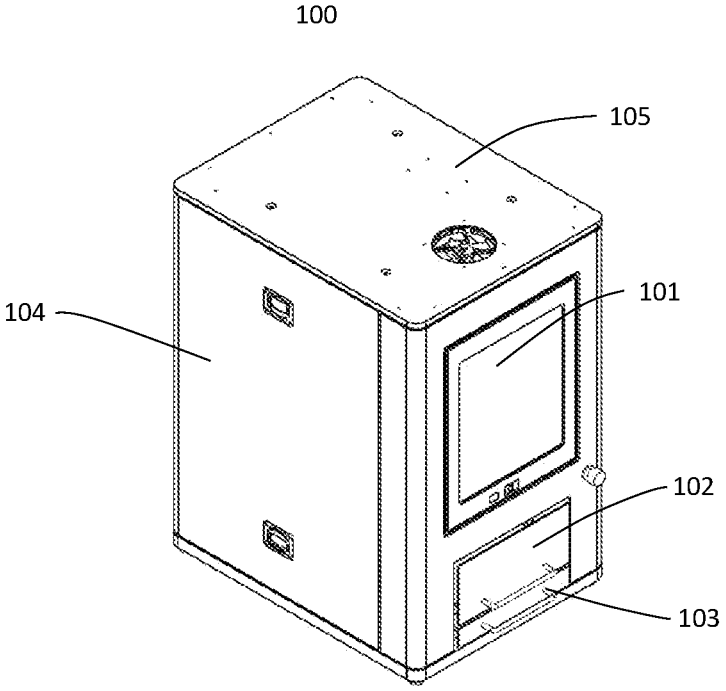
FIG. 1 shows an example of a cartridge filling system in accordance with aspects of the present disclosure.
Figure 2:
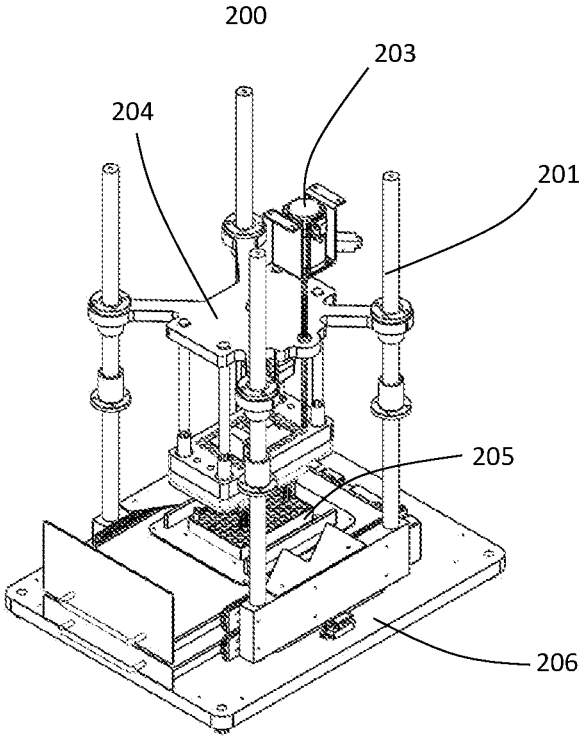
FIG. 2 shows an example of the internal mechanisms used to fill cartridges and how they are organized in a vertical manner.
Figure 3:
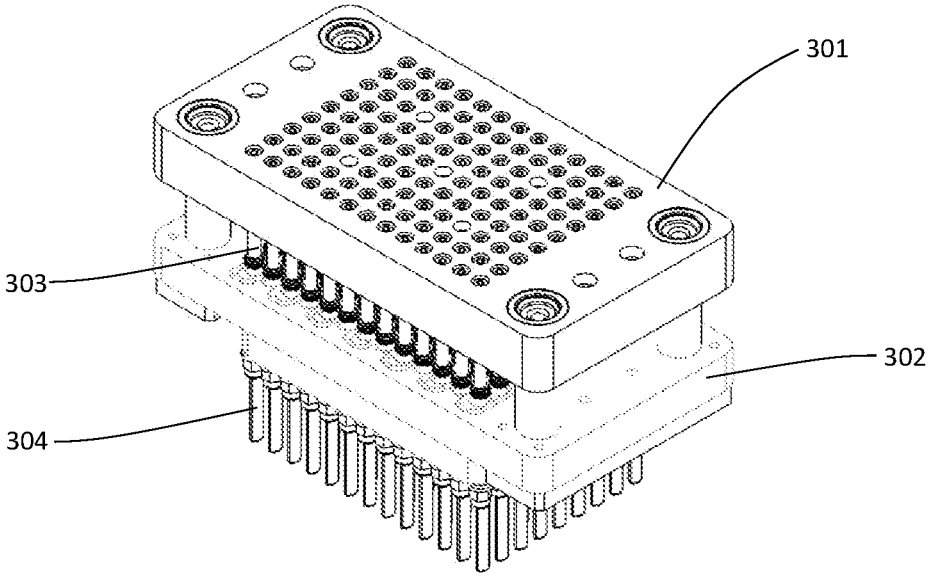
FIG. 3 shows an example of the head assembly with syringe and plunger assemblies in an example configuration during operation.
Figure 4:
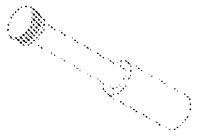
FIG. 4 shows an example of a plunger tip that would be installed into the plunger assembly.
Figure 5:
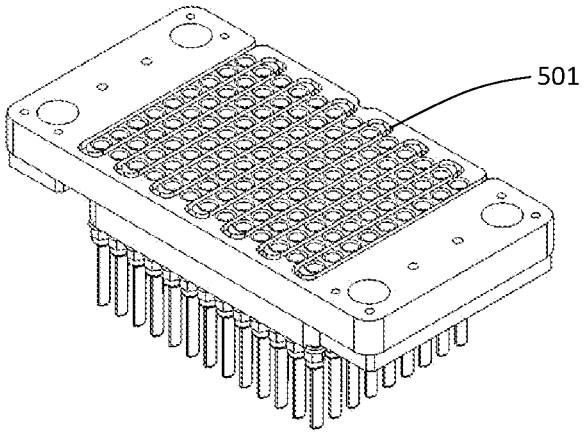
FIG. 5 shows an example of the syringe assembly with an example raceway design for distributing the heating element throughout the assembly.
Figure 6:
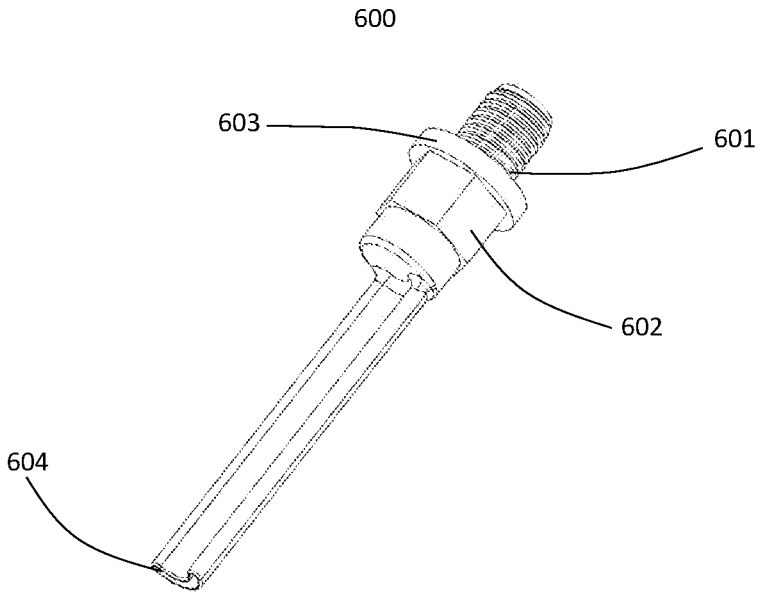
FIG. 6 shows an example of an annular nozzle that would be installed into the syringe assembly.
Figure 7:
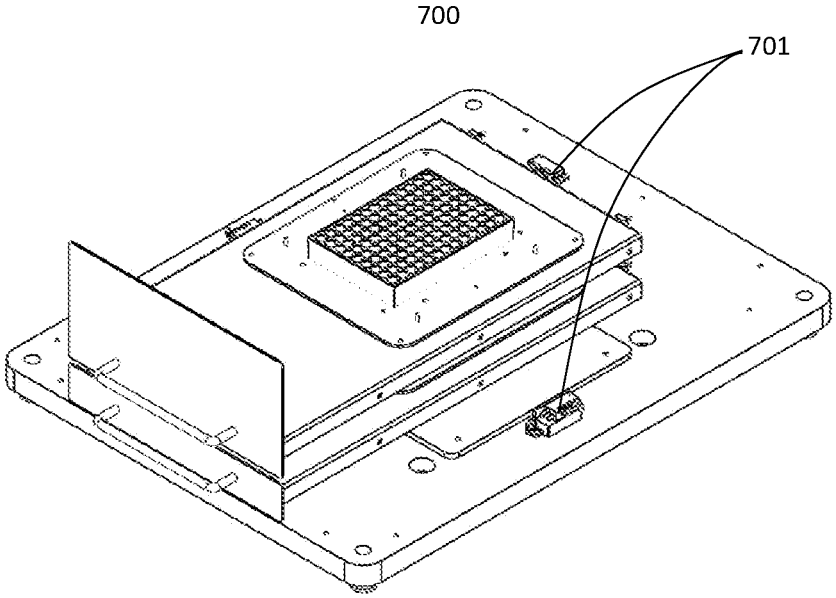
FIG. 7 shows an example of the compartment system configuration with the cartridge compartment above the reservoir compartment.
Figure 8:
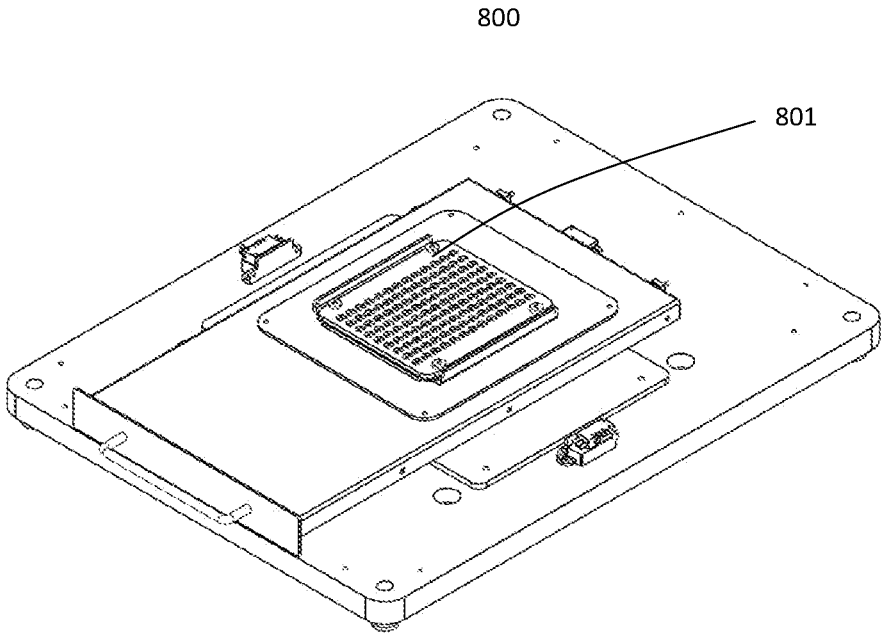
FIG. 8 shows an example of the wiper array on top of the reservoir.
Figure 9:
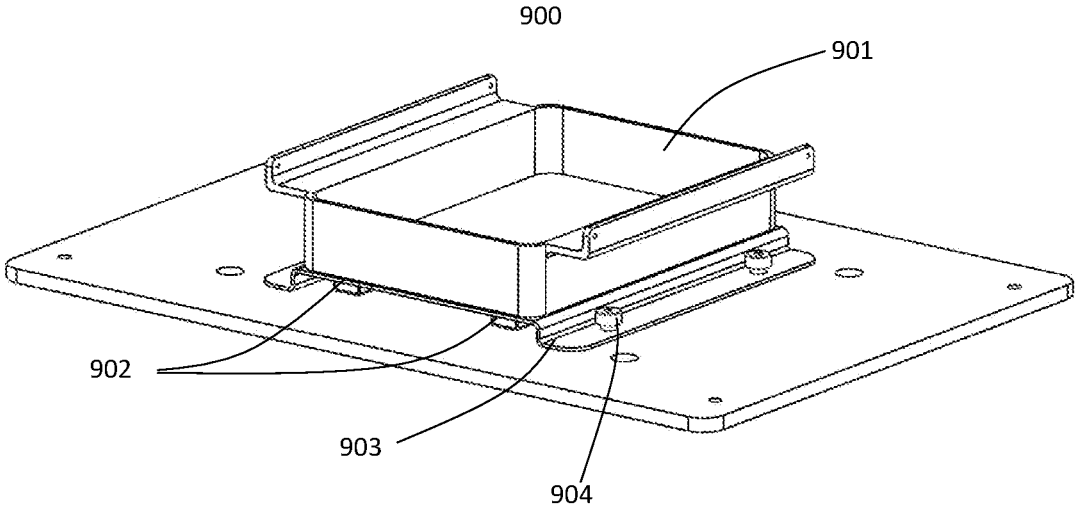
FIG. 9 shows an example of the mechanism to place the reservoir heated bed in intimate contact with the reservoir bottom.

FIG. 1 shows an example of an automated cartridge filling system 100. On the front of the system would rest a display for Human Machine Interface (HMI) capability 101. The front face would have two portals, the cartridge compartment 102 and reservoir compartment 103, through which cartridges and formulation, respectively, are inserted into the system. Both portals may utilize a sliding compartment mechanism to allow the operator to insert or remove cartridges or reservoirs without exposing the internal work area to relatively colder ambient environment. Side panels 104 may be removed to access the internal mechanisms 200.

Electronics components necessary to operate the system, such as power supply units, relays, power distribution blocks, and microcontrollers, among other components, are located in the electronics compartment at the rear of the system.

The cartridge compartment is designed to receive various cartridge types in a tray 205. Cartridges may vary in height, diameter, cross sectional shape, and may also have different ports or openings to discharge formulation through. Similarly, the number of cartridges inserted into the system may vary.

The reservoir compartment is designed to receive a formulation reservoir 901, which will hold sufficient formulation to facilitate some number of consecutive cartridge tray ("tray") fills without replacing the reservoir.

A full reservoir is placed in the reservoir compartment and the compartment is pushed inside the system. As the compartment closes and the reservoir approaches the operating position, the reservoir will come to rest on a heated bed 903 which keeps the reservoir at a constant temperature. Magnets 902 on the underside of the heated bed create intimate contact between the reservoir and bed to facilitate conductive heating of the reservoir. Retaining screws 904 allow the heated bed to rise and fall freely, as the magnets are attracted to the reservoir or fall away when it is removed. When the reservoir compartment is pulled open, the reservoir simply slides along the heated bed until they are no longer in contact, and the heated bed drops to the rest position ready to receive the next reservoir.

Cartridges are then placed in the cartridge compartment and may be locked in place with a latching system that ensures the cartridges remain stationary and aligned during operation. When the cartridge compartment is closed, the system is prepped for operation. Limit switches 701 inside the system sense when the cartridge and reservoir compartments 700 are fully seated to ensure that operation does not occur unless the compartments are fully closed.

Resting above the cartridge compartment is the main mechanism 200 of the described system. A gantry 204 may position the mechanism. The gantry may be driven by a stepper motor 203 with a lead screw, which allows for consistent movement speeds and tunability via the HMI, or some other software update methodology, without mechanically disassembling the system for adjustments. In certain implementations, the gantry travels along four vertical stanchions 201 arranged in a square and mounted to the top surface plate 105 and bottom surface plate 206.

The mechanism may consist of two metallic platens or blocks, the top block the plunger assembly 301 and the bottom block the syringe assembly 302. The plunger assembly moves along the vertical access relative to the syringe assembly, which is fixed to the gantry. A stepper motor with a lead screw drives the plunger assembly motion relative to the syringe assembly. The plunger assembly and syringe assembly together comprise the head assembly 300. The number and layout of cartridges will equal the number and layout of annular nozzles 304 mounted to the syringe assembly, which will equal the number and layout of bores in the syringe assembly 500 which will in turn equal the number and layout of plungers 303 mounted to the plunger assembly.

The syringe and plunger blocks are thermally conductive to facilitate heat transfer throughout the blocks.

In certain implementations, the described system has an interchangeable head assembly.

The head assembly may be removable by a set of four threaded rods and snap rings. This would allow for interfacing with different cartridge geometries and facilitate cleaning.

The plunger assembly consists of the metallic block and plungers 400 individually fastened to the block. In the event a plunger tip breaks, fatigues, or otherwise needs to be replaced, the single plunger may be replaced instead of the entire syringe assembly. Each plunger inserts into a barrel on the syringe assembly and has a silicon or similar material tip on the end which seals the barrel and prevents formulation from escaping the enclosed volume of the barrel.

The syringe assembly consists of a metallic block, heating element, thermistor, and the annular nozzle mounting location. The metallic block may have a raceway 501 milled or otherwise manufactured into the top face. The raceway may travel from one side of the top face back and forth in a weaving manner to the other side of the top face. A heating element, such as wire with sufficient resistance to generate a desired amount of heat when excited with current, rests in the raceway and may be potted to improve the conductivity of the element to the block and keep it in place.

The syringe assembly may also have a number of thermistors distributed across the metallic surface as a means of ensuring the heating is uniform. Additionally, a thermostatic switch may be integrated as a failsafe to ensure that runaway heating is quelled.

On the lower face of the syringe assembly, the annular nozzles 600 may be installed via threads 601 rather than the more common Luer lock. The lower face has a series of threaded holes for the nozzles, with a counterbore at each location for an O-ring gasket to be inserted. When oriented for insertion into the syringe assembly, the three sections of the annular nozzle from the top down are the threaded section which has a shoulder 603 for closing the O-ring seal, a hexagonal cross section central body 602 for loosening or tightening the nozzle, and the applicator annulus 604 which extends from the central body away from the syringe assembly.

The central body additionally has a circular section in the front to allow seal quality testing, to ensure that the threaded nozzle and O-ring can maintain vacuum.

The characteristics of the applicator section will vary with cartridge configurations. For any variation in the annular nozzle, the hydraulic diameter of the chosen cross section would be greater than 1.0, as this is the point at which the force required to discharge viscous formulation through the nozzle diminishes non-linearly as the hydraulic diameter increases. In this way, the custom annular nozzle allows for tunable flow characteristics which may consider both the cartridge geometry, the array of cartridges, and the types of formulation used with the system. In certain implementations, the system may be adapted to work with many other viscous formulations outside of the described electronic vaporizer market.

For operation, the system may be turned on and allowed to initialize, which largely ensures the syringe assembly and reservoir reach the desired temperature before any cartridges are filled. Using the HMI at the front, the operator may select system configurations previously utilized and stored for each formulation type and cartridge combination. This will adjust the temperature of each syringe assembly and reservoir and make adjustments to the motion of the gantry during fill, and to the motion profile of the plunger assembly. For new configurations, the HMI may have a page dedicated to calibrating the system which would then be saved into a library of stored settings.

As stepper motors are easily controllable to the micron level, the plunger motion may be tuned to have any number of motion profiles, with the positioning, speed, and acceleration throughout the stroke all tunable and storable. The described system may also utilize closed loop stepper motors to ensure the positional accuracy of the system is maintained, and to prevent additional damage in the event of some error which prevents motion of the gantry or plunger assembly.

Current monitoring may also be utilized on the stepper motors as a means to approximate the viscosity of the formulation. This may facilitate automatic calibration of the heating system, such that a sample of formulation may be inserted into the system at which point the plunger and syringe assemblies would push and pull the formulation in and out of the barrels in the syringe assembly. If the current required to move the formulation is higher than anticipated, the temperature of the heating systems may be raised, thus decreasing the viscosity and decreasing the current required to move the formulation.

Returning to operation, once the system is initialized, the cartridge tray may be inserted into the system via the cartridge compartment. The reservoir would be inserted into the reservoir compartment during initialization to ensure not just the reservoir bed is at temperature, but the formulation inside the reservoir also reaches the desired temperature. With cartridges and formulation inserted, the HMI may be used to initialize a fill cycle.

The fill cycle initiates by first retracting the system to the home position, which is where the gantry rests between fill cycles to ensure the cartridge tray area is clear. After homing, the gantry moves downward towards the cartridges a set distance. Upon reaching the top of the cartridges, the speed may be decreased for slow insertion of the annular nozzle tips into the cartridges. Once the annular nozzles come to rest inside the cartridges, offset some distance from the bottom of the cartridge, the plunger assembly stroke commences while the gantry simultaneously rises away from the cartridge slowly. This will ensure the formulation exits the nozzle without getting stuck to the exterior of the nozzle if the formulation builds up around the inside of the cartridge.

Once the plunger stroke is complete, the gantry does not return all the way to the home position, but instead rests above the cartridge tray such that the cartridges can be pulled out. Once the cartridges compartment is pulled out by the operator to extract the filled cartridges and insert new cartridges, the gantry travels down towards the reservoir. The reservoir has a series of wipers 801 on top of the reservoir made from silicon or similar material that wipe any clinging formulation off the nozzle. The nozzles enter the reservoir through the wipers and come to rest near the bottom of the reservoir. At this point, the plunger assembly retracts, drawing formulation from the reservoir into the barrels of the syringe assembly. In certain implementations, the reservoir may hold more than 1-tray fill worth of formulation. The volume per tray fill will vary both with the configuration of the cartridge and the desired fill volume, or in some cases mass, of the cartridge.

Once the barrels are full of formulation, the gantry moves upwards towards the home position. As the nozzles exit the reservoir, the wipers ensure that excess formulation clinging to the outside of the nozzles is removed. Once the gantry clears the cartridge compartment, the tray with empty cartridges may be inserted into the system for the process to commence anew. This process continues for some number of cycles while the formulation inside the reservoir is depleted. The operator may have another reservoir available which is full and near the operation temperature. At the point where the reservoir is empty, or insufficiently full to allow another full cycle of filling, the reservoir compartment may be opened while the cartridges are being filled to swap out the reservoir.

The invention claimed is:

1. A system for filling cartridges with viscous liquid, the system comprising:

a top plunger assembly having multiple plungers coupled to a bottom side of the top plunger assembly, the top plunger assembly moveable in a vertical axis; and a bottom syringe assembly having multiple cavities and a plurality of annular nozzles coupled to a bottom side of the syringe assembly, the bottom syringe assembly moveable in the vertical axis; and the plurality of annular nozzles each comprising:

a threaded base;

a shoulder to seal the nozzle with a gasket;

a polyhedron center body; and an annular cross section having a tip;

a cartridge tray configured to hold the cartridges, the cartridge tray removable from the system;

wherein an actuation of the top plunger assembly causes the viscous liquid to discharge into the cartridges held in the cartridge tray when the multiple plungers are moved downward in the multiple cavities.

2. The system of claim 1, wherein the tip has a hydraulic diameter greater than 1.0.

3. The system of claim 2, wherein the top plunger assembly comprises:

a metallic block with mounting locations;

a gantry for positioning the metallic block vertically within the system; and stanchions along which the gantry traverses.

4. The system of claim 2, wherein the bottom syringe assembly comprises:

a metal block with an array of bores comprising the plurality of cavities;

a raceway and heating element to facilitate heating;

a plurality of thermistors for temperature sensing; and threaded mounting locations for attachment of the annular nozzles.

5. The system of claim 1, wherein the polyhedron center body is made from thermally insulative material.

6. The system of claim 1 further comprising an enclosed internal volume with compartments for inserting and removing cartridges and liquid without exposing the internal volume to the external ambient environment.

7. The system of claim 1 further comprising removable side panels for accessing the internal mechanisms.

8. The system of claim 1 further comprising a magnetically activated mechanism for placing a reservoir heating bed in intimate contact with a liquid reservoir.

9. The system of claim 1 further comprising a latching system which secures and aligns cartridges when inserted into the system.

10. The system of claim 1, the system further comprising:

a reservoir configured to hold the viscous liquid, the reservoir positioned below the bottom syringe assembly; and the reservoir including multiple wipers.

11. A method comprising the operations of:

providing a system for filing cartridges with viscous liquid, the system comprising:

a top plunger assembly having multiple plungers coupled to a bottom side of the top plunger assembly, the top plunger assembly moveable in a vertical axis; and a bottom syringe assembly having multiple cavities and a plurality of annular nozzles coupled to a bottom side of the syringe assembly, the bottom syringe assembly moveable in the vertical axis; and a cartridge tray configured to hold vape cartridges, the cartridge tray removeable from the system; and the plurality of annular nozzles comprising:

a threaded base;

a shoulder to seal the nozzle with a gasket;

a polyhedron center body; and an annular cross section having a tip; and a top plunger assembly; and wherein the plurality of annular nozzles are coupled to the bottom block assembly;

injecting a viscous liquid into the system; and actuating the top plunger assembly to inject the viscous liquid into the vape cartridges via the plurality of annular nozzles when the plurality of plungers are moved downward in the plurality of cavities.

12. The method of claim 11, wherein the tip has a hydraulic diameter greater than 1.0.

13. The method of claim 12, wherein the top plunger assembly comprises:

a metallic block with mounting locations;

a gantry for positioning the metallic block vertically within the system; and stanchions along which the gantry traverses.

14. The method of claim 12, wherein the bottom syringe assembly comprises:

a metal block with an array of bores comprising the plurality of cavities;

a raceway and heating element to facilitate heating;

a plurality of thermistors for temperature sensing; and threaded mounting locations for attachment of the annular nozzles.

15. The method of claim 11, wherein the polyhedron center body is made from thermally insulative material.

16. The method of claim 11 further comprising an enclosed internal volume with compartments for inserting and removing cartridges and liquid without exposing the internal volume to the external ambient environment.

17. The method of claim 11 further comprising removable side panels for accessing the internal mechanisms.

18. The method of claim 11 further comprising the operations of:

placing a reservoir heating bed in intimate contact with a liquid reservoir via a magnetically activated mechanism.

19. The method of claim 11 further comprising the operations of:

securing and aligning, via a latching system, the vape cartridges when inserted into the system.

20. The method of claim 11, further comprising the operations of:

inserting the plurality of annular nozzles into a reservoir;

withdrawing the viscous liquid from the reservoir via the plurality of annular nozzles; and wiping the annular nozzles with wipers.

* * * * *